US009384746B2

(12) United States Patent
Atti et al.

(10) Patent No.: US 9,384,746 B2
(45) Date of Patent: Jul. 5, 2016

(54) SYSTEMS AND METHODS OF ENERGY-SCALED SIGNAL PROCESSING

(71) Applicant: QUALCOMM Incorporated, San Diego, CA (US)

(72) Inventors: Venkatraman S. Atti, San Diego, CA (US); Venkatesh Krishnan, San Diego, CA (US); Stephane Pierre Villette, San Diego, CA (US); Vivek Rajendran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 33 days.

(21) Appl. No.: 14/512,892

(22) Filed: Oct. 13, 2014

(65) Prior Publication Data

US 2015/0106107 A1 Apr. 16, 2015

Related U.S. Application Data

(60) Provisional application No. 61/890,812, filed on Oct. 14, 2013.

(51) Int. Cl.
*G10L 19/035* (2013.01)
*G10L 21/038* (2013.01)
(Continued)

(52) U.S. Cl.
CPC ..... *G10L 19/035* (2013.01); *G10L 21/038* (2013.01); *G10L 19/0204* (2013.01); *G10L 19/08* (2013.01); *G10L 19/083* (2013.01)

(58) Field of Classification Search
CPC ... G10L 19/0204; G10L 19/04; G10L 19/002; G10L 19/025; G10L 19/008; G10L 19/20; G10L 19/265; G10L 21/038; G10L 21/0388
USPC ..... 704/500, 203, 205, 206, 229, 236, 501, 704/503, 219, 225, 230
See application file for complete search history.

(56) References Cited

U.S. PATENT DOCUMENTS 6,141,638 A 10/2000 Peng et al.
6,449,313 B1 9/2002 Erzin et al.
(Continued)

FOREIGN PATENT DOCUMENTS

EP 1498873 A1 1/2005
WO 0223536 A2 3/2002
WO 2012158157 A1 11/2012

OTHER PUBLICATIONS

Blamey, et al., "Formant-Based Processing for Hearing Aids," Human Communication Research Centre, University of Melbourne, pp. 273-pp. 278, Jan. 1993.
(Continued)

*Primary Examiner* — Charlotte M Baker
(74) *Attorney, Agent, or Firm* — Toler Law Group, PC

(57) ABSTRACT

A method includes determining a first modeled high-band signal based on a low-band excitation signal of an audio signal, where the audio signal includes a high-band portion and a low-band portion. The method also includes determining scaling factors based on energy of sub-frames of the first modeled high-band signal and energy of corresponding sub-frames of the high-band portion of the audio signal. The method includes applying the scaling factors to a modeled high-band excitation signal to determine a scaled high-band excitation signal and determining a second modeled high-band signal based on the scaled high-band excitation signal. The method includes determining gain parameters based on the second modeled high-band signal and the high-band portion of the audio signal.

31 Claims, 9 Drawing Sheets

(51) Int. Cl.

| | |
|---|---|
| *G10L 19/08* | (2013.01) |
| *G10L 19/083* | (2013.01) |
| *G10L 19/02* | (2013.01) |

(56) References Cited

U.S. PATENT DOCUMENTS

| | | | | |
|---|---|---|---|---|
| 6,629,068 | B1 | 9/2003 | Horos et al. | |
| 6,704,701 | B1 | 3/2004 | Gao | |
| 6,766,289 | B2 | 7/2004 | Kandhadai et al. | |
| 6,795,805 | B1 | 9/2004 | Bessette et al. | |
| 7,117,146 | B2 | 10/2006 | Gao | |
| 7,272,556 | B1 | 9/2007 | Aguilar et al. | |
| 7,680,653 | B2 | 3/2010 | Yeldener | |
| 7,788,091 | B2 | 8/2010 | Goudar et al. | |
| 8,352,279 | B2 * | 1/2013 | Gao | G10L 19/0204 704/219 |
| 8,600,765 | B2 * | 12/2013 | Liu | G10L 19/20 704/203 |
| 2002/0147583 | A1 | 10/2002 | Gao | |
| 2003/0115042 | A1 | 6/2003 | Chen et al. | |
| 2003/0128851 | A1 | 7/2003 | Furuta | |
| 2004/0093205 | A1 | 5/2004 | Ashley et al. | |
| 2006/0147124 | A1 | 7/2006 | Edler et al. | |
| 2006/0173691 | A1 | 8/2006 | Mukaide | |
| 2008/0027718 | A1 | 1/2008 | Krishnan et al. | |
| 2008/0114605 | A1 | 5/2008 | Wu et al. | |
| 2008/0208575 | A1 | 8/2008 | Laaksonen et al. | |
| 2009/0254783 | A1 | 10/2009 | Hirschfeld et al. | |
| 2010/0241433 | A1 | 9/2010 | Herre et al. | |
| 2010/0332223 | A1 | 12/2010 | Morii et al. | |
| 2011/0099004 | A1 | 4/2011 | Krishnan et al. | |
| 2011/0295598 | A1 | 12/2011 | Yang et al. | |
| 2012/0101824 | A1 | 4/2012 | Chen | |
| 2012/0221326 | A1 | 8/2012 | Grancharov et al. | |
| 2012/0300946 | A1 | 11/2012 | Ma | |
| 2012/0323571 | A1 | 12/2012 | Song et al. | |
| 2015/0235653 | A1 * | 8/2015 | Liu | G10L 21/0388 704/500 |

OTHER PUBLICATIONS

Boillot, et al., "A Loudness Enhancement Technique for Speech," IEEE, 0-7803-8251-X/04, ISCAS 2004, pp. V-616-pp. V-619, 2004.

Cheveigne, "Formant Bandwidth Affects the Identification of Competing Vowels," CNRS—IRCAM, France, and ATR-HIP, Japan, p. 1-p. 4, 1999.

Coelho, et al., "Voice Pleasantness: on the Improvement of TTS Voice Quality," Instituto Politécnico do Porto, ESEIG, Porto, Portugal, MLDC—Microsoft Language Development Center, Lisbon, Portugal, Universidade de Vigo, Dep. Teoria de la Señal e Telecomuniçõns, Vigo, Spain, p. 1-p. 6, download.microsoft.com/download/a/0/b/a0b1a66a-5ebf-4cf3-9453-4b13bb027f1f/jth08voicequality.pdf.

Cole, et al., "Speech Enhancement by Formant Sharpening in the Cepstral Domain," Proceedings of the 9th Australian International Conference on Speech Science & Technology, Australian Speech Science & Technology Association Inc., pp. 244-pp. 249, Melbourne, Australia, Dec. 2-5, 2002.

Cox, "Current Methods of Speech Coding," Signal Compression: Coding of Speech, Audio, Text, Image and Video, ed. N. Jayant, ISBN-13: 9789810237653, vol. 7, No. 1, pp. 31-pp. 39, 1997.

ISO/IEC 14496-3:2005(E), Subpart 3: Speech Coding—CELP, pp. 1-165, 2005.

ITU-T, "Series G: Transmission Systems and Media, Digital Systems and Networks, Digital terminal equipments—Coding of analogue signals by methods other than PCM, Dual rate speech coder for multimedia communications transmitting at 5.3 and 6.3 kbit/s", G.723.1, ITU-T, pp. 1-pp. 64, May 2006.

Jokinen, et al., "Comparison of Post-Filtering Methods for Intelligibility Enhancement of Telephone Speech," 20th European Signal Processing Conference (EUSIPCO 2012), ISSN 2076-1465, p. 2333-p.2337, Bucharest, Romania, Aug. 27-31, 2012.

Taniguchi T et AL, "Pitch Sharpeing for Perceptually Improved CELP, and the Sparse-Delta Codebook for Reduced Computation", Proceedings from the International Conference on Acoustics, Speech & Signal Processing, ICASSP, pp. 241-244, Apr. 14-17, 1991.

Zorila, et al., "Improving Speech Intelligibility in Noise Environments by Spectral Shaping and Dymanic Range Compression," The Listening Talker—An Interdisciplinary Workshop on Natural and Synthetic Modification of Speech, LISTA Workshop in Response to Listening Conditions. Edinburgh, May 2-3, 2012, pp. 1.

Zorila, et al., "Improving Sppech Intelligibility in Noise Environments by Spectral Shaping and Dynamic Range Compression," FORTH—Institute of Computer Science, Listening Talker, pp. 1.

Zorila, et al., "Speech-In-Noise Intelligibility Improvement Based on Power Recovery and Dynamic Range Compression," 20th European Signal Processing Conference (EUSIPCO 2012), ISSN 2076-1465, pp. 2075-pp. 2079, Bucharest, Romania, Aug. 27-31, 2012.

International Search Report and Written Opinion for International Application No. PCT/US2014/060448, ISA/EPO, Date of Mailing Jan. 16, 2015, 10 pages.

* cited by examiner $$LSP_{Sub\text{-}frame\ 1} = (w_1)(LSP_{N-1})+(w_2)(LSP_N)$$
$$LSP_{Sub\text{-}frame\ 2} = (w_4)(LSP_{N-1})+(w_5)(LSP_N)$$
$$LSP_{Sub\text{-}frame\ 3} = (w_7)(LSP_{N-1})+(w_8)(LSP_N)$$
$$LSP_{Sub\text{-}frame\ 4} = (w_{10})(LSP_{N-1})+(w_{11})(LSP_N)$$

$$LSP_{Sub\text{-}frame\ 1} = (w_1)(LSP_2_{N-1}) + (w_2)(LSP_1_N) + (w_3)(LSP_2_N)$$

$$LSP_{Sub\text{-}frame\ 2} = (w_4)(LSP_2_{N-1}) + (w_5)(LSP_1_N) + (w_6)(LSP_2_N)$$

$$LSP_{Sub\text{-}frame\ 3} = (w_7)(LSP_1_N) + (w_8)(LSP_2_N)$$

$$LSP_{Sub\text{-}frame\ 4} = (w_9)(LSP_1_N) + (w_{10})(LSP_2_N)$$

SYSTEMS AND METHODS OF ENERGY-SCALED SIGNAL PROCESSING

The present application claims priority from U.S. Provisional Patent Application No. 61/890,812, entitled "SYSTEMS AND METHODS OF ENERGY-SCALED SIGNAL PROCESSING," filed Oct. 14, 2013, the contents of which is incorporated by reference in its entirety.

I. FIELD

The present disclosure is generally related to signal processing.

II. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

In traditional telephone systems (e.g., public switched telephone networks (PSTNs)), signal bandwidth is limited to the frequency range of 300 Hertz (Hz) to 3.4 kiloHertz (kHz). In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve speech intelligibility and naturalness.

SWB coding techniques typically involve encoding and transmitting the lower frequency portion of the signal (e.g., 50 Hz to 7 kHz, also called the "low-band"). For example, the low-band may be represented using filter parameters and/or a low-band excitation signal. However, in order to improve coding efficiency, the higher frequency portion of the signal (e.g., 7 kHz to 16 kHz, also called the "high-band") may be encoded using signal modeling techniques to predict the high-band. In some implementations, data associated with the high-band may be provided to the receiver to assist in the prediction. Such data may be referred to as "side information," and may include gain information, line spectral frequencies (LSFs, also referred to as line spectral pairs (LSPs)), etc. The gain information may include gain shape information determined based on sub-frame energies of both the high-band signal and the modeled high-band signal. The gain shape information may have a wider dynamic range (e.g., large swings) due to differences in the original high-band signal relative to the modeled high-band signal. The wider dynamic range may reduce efficiency of an encoder used to encode/transmit the gain shape information.

III. SUMMARY

Systems and methods of performing audio signal encoding are disclosed. In a particular embodiment, an audio signal is encoded into a bit stream or data stream that includes a low-band bit stream (representing a low-band portion of the audio signal) and high-band side information (representing a high-band portion of the audio signal). The high-band side information may be generated using the low-band portion of the audio signal. For example, a low-band excitation signal may be extended to generate a high-band excitation signal. The high-band excitation signal may be used to generate (e.g., synthesize) a first modeled high-band signal. Energy differences between the high-band signal and the modeled high-band signal may be used to determine scaling factors (e.g., a first set of one or more scaling factors). The scaling factors (or a second set of scaling factors determined based on the first set of scaling factors) may be applied to the high-band excitation signal to generate (e.g., synthesize) a second modeled high-band signal. The second modeled high-band signal may be used to determine the high-band side information. Since the second modeled high-band signal is scaled to account for energy differences with respect to the high-band signal, the high-band side information based on the second modeled high-band signal may have a reduced dynamic range relative to high-band side information determined without scaling to account for energy differences.

In a particular embodiment, a method includes determining a first modeled high-band signal based on a low-band excitation signal of an audio signal. The audio signal includes a high-band portion and a low-band portion. The method also includes determining scaling factors based on energy of sub-frames of the first modeled high-band signal and energy of corresponding sub-frames of the high-band portion of the audio signal. The method includes applying the scaling factors to a modeled high-band excitation signal to determine a scaled high-band excitation signal and determining a second modeled high-band signal based on the scaled high-band excitation signal. The method also includes determining gain information based on the second modeled high-band signal and the high-band portion of the audio signal.

In another particular embodiment, an apparatus includes a first synthesis filter configured to determine a first modeled high-band signal based on a low-band excitation signal of an audio signal, where the audio signal includes a high-band portion and a low-band portion. The apparatus also includes a scaling module configured to determine scaling factors based on energy of sub-frames of the first modeled high-band signal and energy of corresponding sub-frames of the high-band portion of the audio signal and to apply the scaling factors to a modeled high-band excitation signal to determine a scaled high-band excitation signal. The apparatus also includes a second synthesis filter configured to determine a second modeled high-band signal based on the scaled high-band excitation signal. The apparatus also includes a gain estimator configured to determine gain information based on the second modeled high-band signal and the high-band portion of the audio signal.

In another particular embodiment, a device includes means for determining a first modeled high-band signal based on a low-band excitation signal of an audio signal, where the audio signal includes a high-band portion and a low-band portion. The device also includes means for determining scaling factors based on energy of sub-frames of the first modeled high-band signal and energy of corresponding sub-frames of the high-band portion of the audio signal. The device also includes means for applying the scaling factors to a modeled high-band excitation signal to determine a scaled high-band excitation signal. The device also includes means for determining a second modeled high-band signal based on the scaled high-band excitation signal. The device also includes means for determining gain information based on the second modeled high-band signal and the high-band portion of the audio signal.

In another particular embodiment, a non-transitory computer-readable medium includes instructions that, when executed by a computer, cause the computer to perform operations including determining a first modeled high-band signal based on a low-band excitation signal of an audio signal, where the audio signal includes a high-band portion and a low-band portion. The operations also include determining scaling factors based on energy of sub-frames of the first modeled high-band signal and energy of corresponding sub-frames of the high-band portion of the audio signal. The operations also include applying the scaling factors to a modeled high-band excitation signal to determine a scaled high-band excitation signal. The operations also include determining a second modeled high-band signal based on the scaled high-band excitation signal. The operations also include determining gain parameters based on the second modeled high-band signal and the high-band portion of the audio signal.

Particular advantages provided by at least one of the disclosed embodiments include reducing a dynamic range of gain information provided to an encoder by scaling a modeled high-band excitation signal that is used to calculate the gain information. For example, the modeled high-band excitation signal may be scaled based on energies of sub-frames of a modeled high-band signal and corresponding sub-frames of a high-band portion of an audio signal. Scaling the modeled high-band excitation signal in this manner may capture variations in the temporal characteristics from sub-frame-to-sub-frame and reduce dependence of the gain shape information on temporal changes in the high-band portion of an audio signal. Other aspects, advantages, and features of the present disclosure will become apparent after review of the entire application, including the following sections: Brief Description of the Drawings, Detailed Description, and the Claims.

IV. BRIEF DESCRIPTION OF THE DRAWINGS

Figure 1:
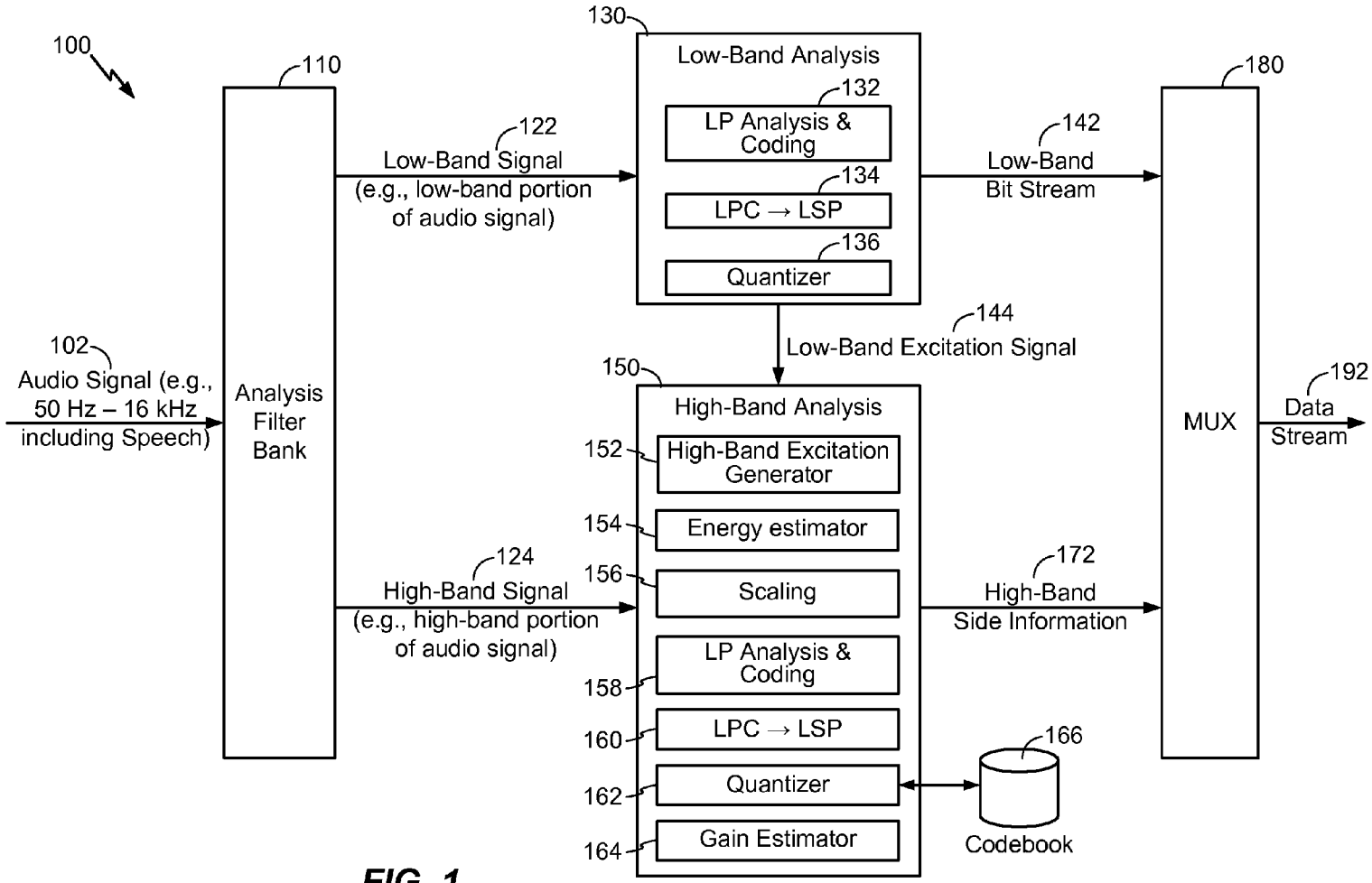
FIG. 1 is a diagram to illustrate a particular embodiment of a system that is operable to generate high-band side information based on a scaled modeled high-band excitation signal.
Figure 5:
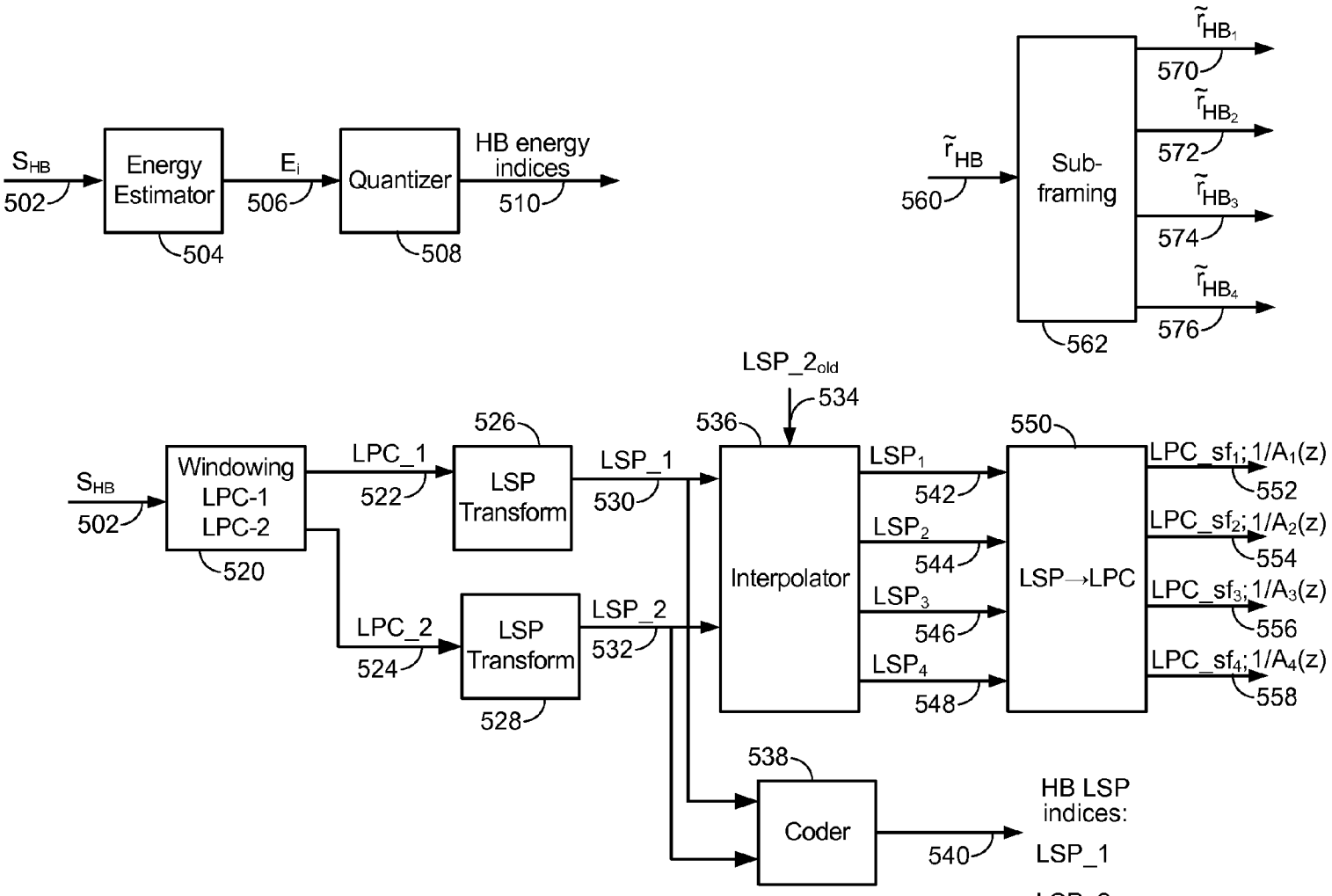
Figure 6:
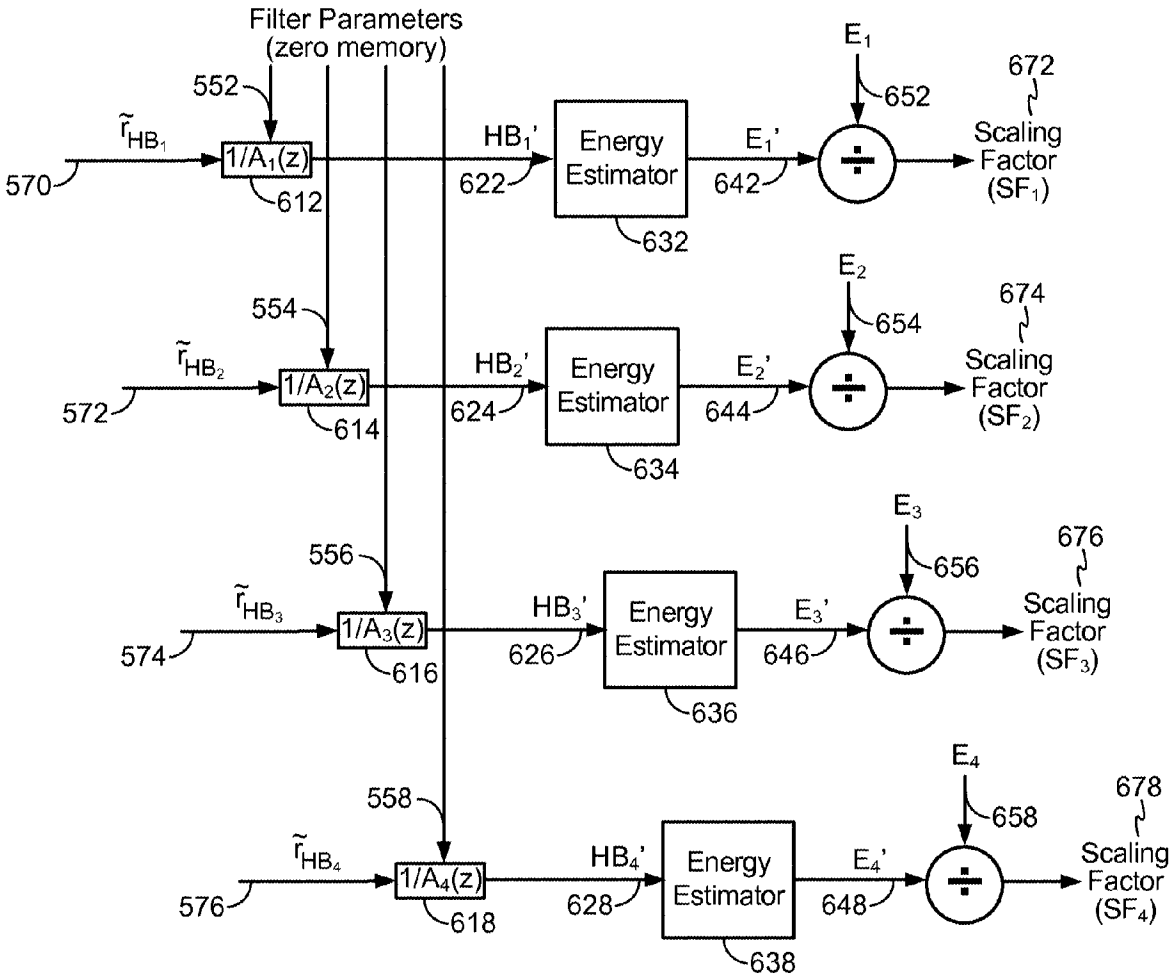
Figure 7:
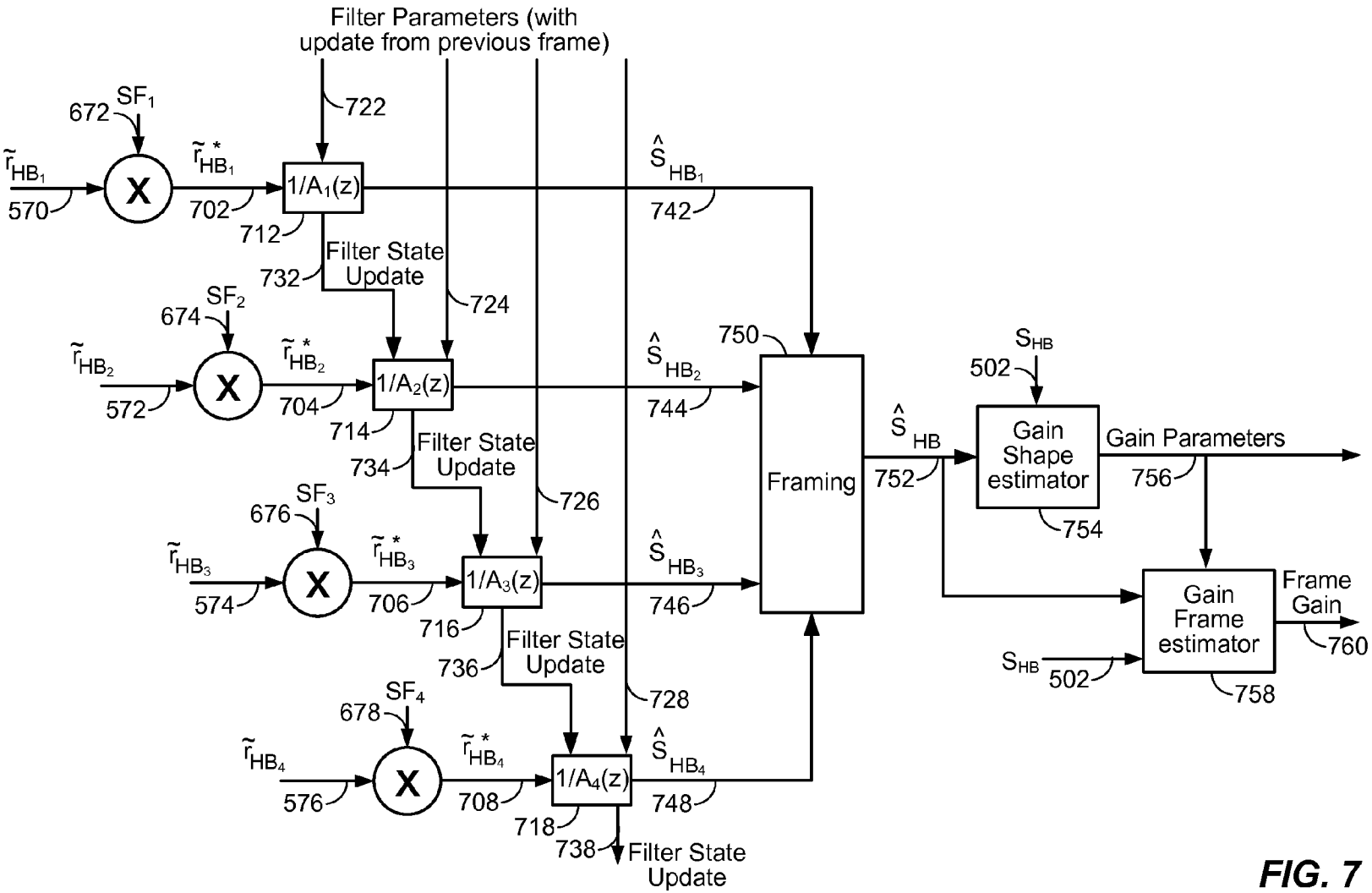
Figure 8:
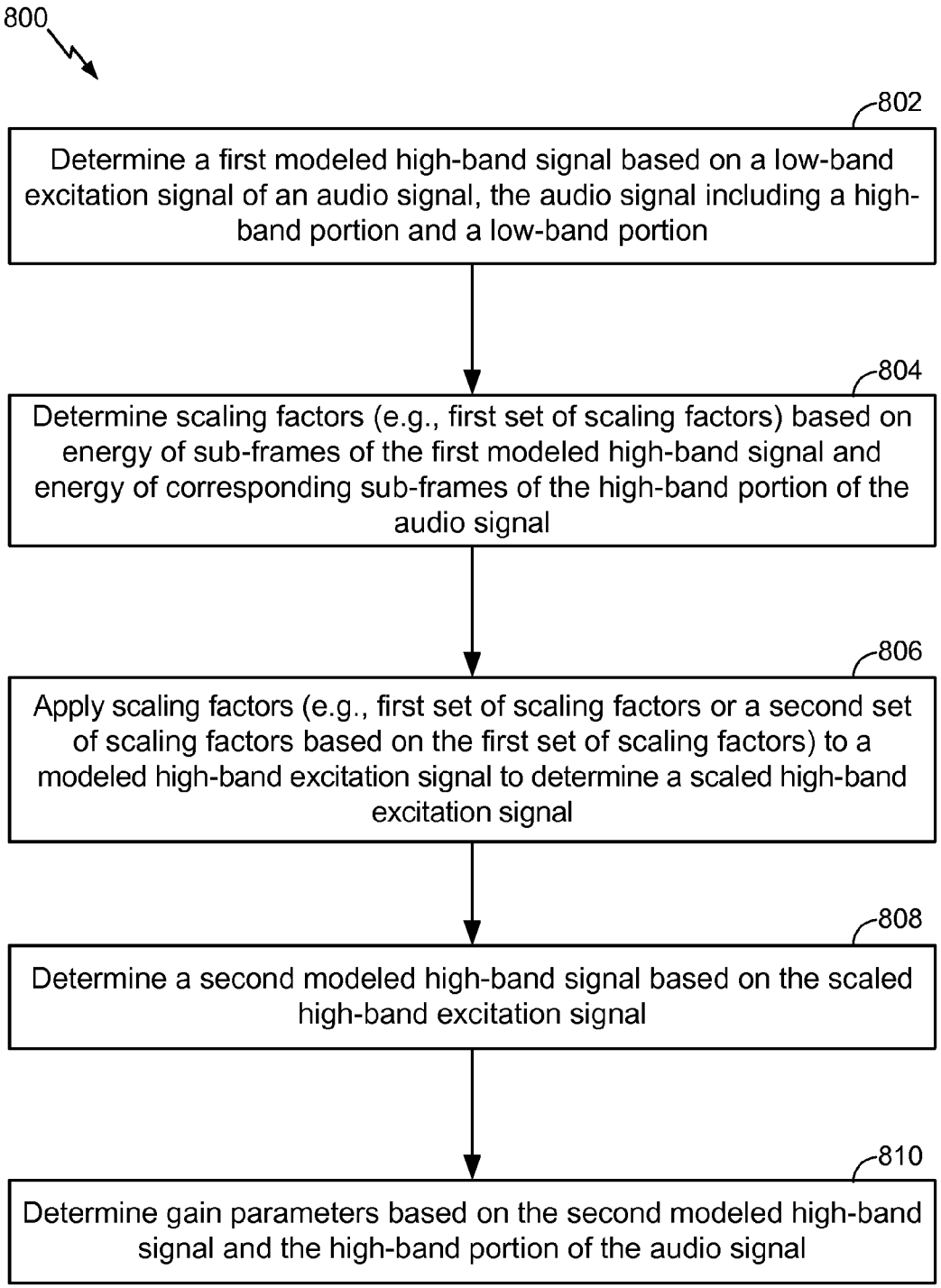
Figure 9:
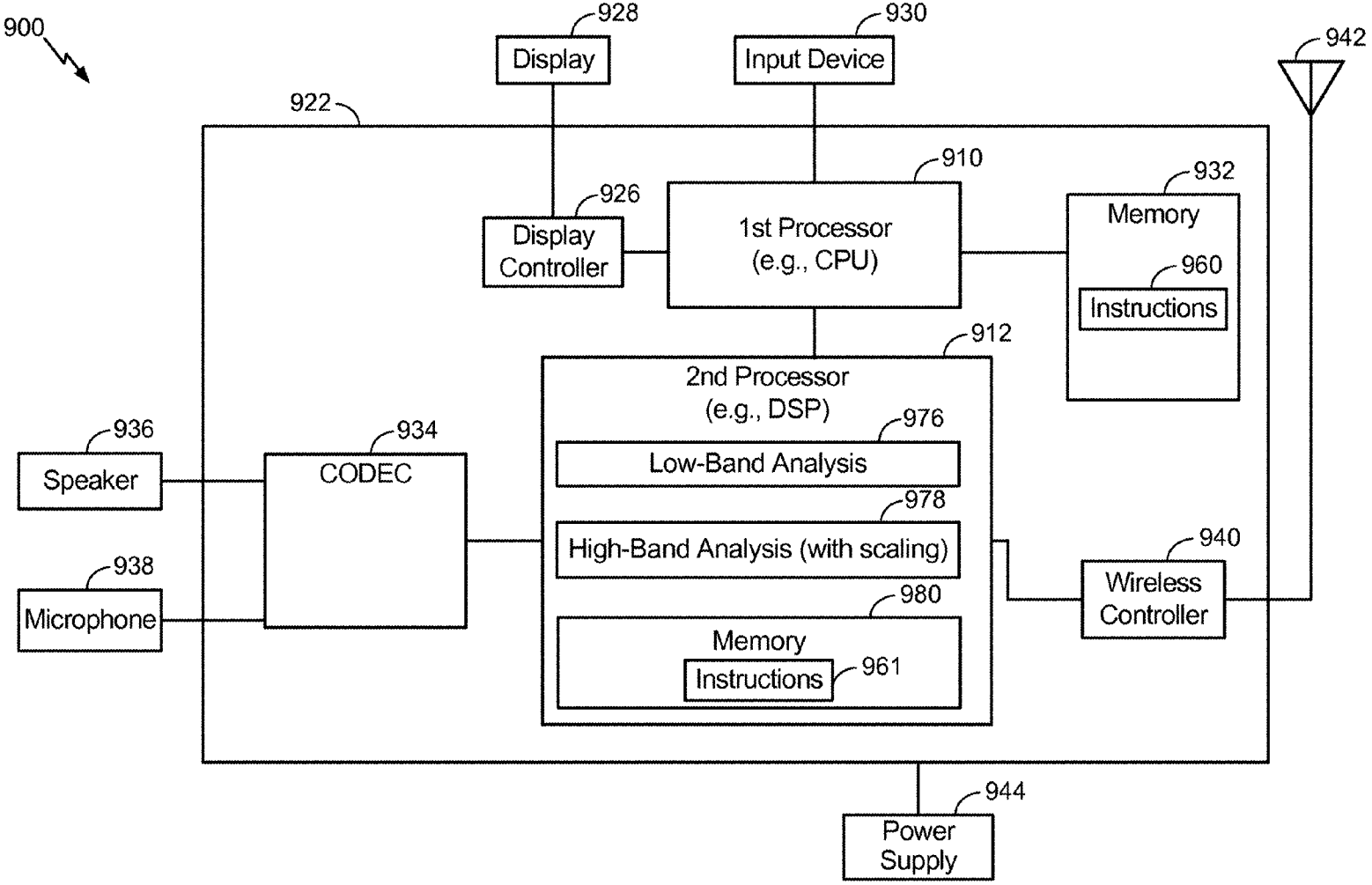

FIGS. 5-7 together are diagrams to illustrate another particular embodiment of a high-band analysis module of FIG. 1;

FIG. 8 is a flowchart to illustrate a particular embodiment of a method of audio signal processing;

FIG. 9 is a block diagram of a wireless device operable to perform signal processing operations in accordance with the systems and methods of FIGS. 1-8.

V. DETAILED DESCRIPTION

FIG. 1 is a diagram to illustrate a particular embodiment of a system 100 that is operable to generate high-band side information based on a scaled modeled high-band excitation signal. In a particular embodiment, the system 100 may be integrated into an encoding system or apparatus (e.g., in a wireless telephone or coder/decoder (CODEC)).

In the following description, various functions performed by the system 100 of FIG. 1 are described as being performed by certain components or modules. However, this division of components and modules is for illustration only. In an alternate embodiment, a function performed by a particular component or module may instead be divided amongst multiple components or modules. Moreover, in an alternate embodiment, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The system 100 includes an analysis filter bank 110 that is configured to receive an audio signal 102. For example, the audio signal 102 may be provided by a microphone or other input device. In a particular embodiment, the input audio signal 102 may include speech. The audio signal 102 may be a SWB signal that includes data in the frequency range from approximately 50 hertz (Hz) to approximately 16 kilohertz (kHz). The analysis filter bank 110 may filter the input audio signal 102 into multiple portions based on frequency. For example, the analysis filter bank 110 may generate a low-band signal 122 and a high-band signal 124. The low-band signal 122 and the high-band signal 124 may have equal or unequal bandwidths, and may be overlapping or non-overlapping. In an alternate embodiment, the analysis filter bank 110 may generate more than two outputs.

In the example of FIG. 1, the low-band signal 122 and the high-band signal 124 occupy non-overlapping frequency bands. For example, the low-band signal 122 and the high-band signal 124 may occupy non-overlapping frequency bands of 50 Hz-7 kHz and 7 kHz-16 kHz, respectively. In an alternate embodiment, the low-band signal 122 and the high-band signal 124 may occupy non-overlapping frequency bands of 50 Hz-8 kHz and 8 kHz-16 kHz, respectively. In another alternate embodiment, the low-band signal 122 and the high-band signal 124 overlap (e.g., 50 Hz-8 kHz and 7 kHz-16 kHz, respectively), which may enable a low-pass filter and a high-pass filter of the analysis filter bank 110 to have a smooth rolloff, which may simplify design and reduce cost of the low-pass filter and the high-pass filter. Overlapping the low-band signal 122 and the high-band signal 124 may also enable smooth blending of low-band and high-band signals at a receiver, which may result in fewer audible artifacts.

Although the description of FIG. 1 relates to processing of a SWB signal, this is for illustration only. In an alternate embodiment, the input audio signal 102 may be a WB signal having a frequency range of approximately 50 Hz to approximately 8 kHz. In such an embodiment, the low-band signal 122 may correspond to a frequency range of approximately 50 Hz to approximately 6.4 kHz, and the high-band signal 124 may correspond to a frequency range of approximately 6.4 kHz to approximately 8 kHz.

The system 100 may include a low-band analysis module 130 (also referred to as a low-band encoder) configured to receive the low-band signal 122. In a particular embodiment, the low-band analysis module 130 may represent an embodiment of a code excited linear prediction (CELP) encoder. The low-band analysis module 130 may include a linear prediction (LP) analysis and coding module 132, a linear prediction coefficient (LPC) to line spectral pair (LSP) transform module 134, and a quantizer 136. LSPs may also be referred to as line spectral frequencies (LSFs), and the two terms may be used interchangeably herein. The LP analysis and coding module 132 may encode a spectral envelope of the low-band signal 122 as a set of LPCs. LPCs may be generated for each frame of audio (e.g., 20 milliseconds (ms) of audio, corresponding to 320 samples at a sampling rate of 16 kHz), each sub-frame of audio (e.g., 5 ms of audio), or any combination thereof. The number of LPCs generated for each frame or sub-frame may be determined by the "order" of the LP analysis performed. In a particular embodiment, the LP analysis and coding module 132 may generate a set of eleven LPCs corresponding to a tenth-order LP analysis.

The LPC to LSP transform module 134 may transform the set of LPCs generated by the LP analysis and coding module 132 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 136 may quantize the set of LSPs generated by the transform module 134. For example, the quantizer 136 may include or may be coupled to multiple codebooks (not shown) that include multiple entries (e.g., vectors). To quantize the set of LSPs, the quantizer 136 may identify entries of codebooks that are "closest to" (e.g., based on a distortion measure such as least squares or mean square error) the set of LSPs. The quantizer 136 may output an index value or series of index values corresponding to the location of the identified entries in the codebook. The output of the quantizer 136 may represent low-band filter parameters that are included in a low-band bit stream 142. The low-band bit stream 142 may thus include linear prediction code data representing the low-band portion of the audio signal 102.

The low-band analysis module 130 may also generate a low-band excitation signal 144. For example, the low-band excitation signal 144 may be an encoded signal that is generated by quantizing a LP residual signal that is generated during the LP process performed by the low-band analysis module 130. The LP residual signal may represent prediction error.

The system 100 may further include a high-band analysis module 150 configured to receive the high-band signal 124 from the analysis filter bank 110 and the low-band excitation signal 144 from the low-band analysis module 130. The high-band analysis module 150 may generate high-band side information 172 based on the high-band signal 124 and the low-band excitation signal 144. For example, the high-band side information 172 may include data representing high-band LSPs, data representing gain information (e.g., based on at least a ratio of high-band energy to low-band energy), data representing scaling factors, or a combination thereof.

The high-band analysis module 150 may include a high-band excitation generator 152. The high-band excitation generator 152 may generate a high-band excitation signal (such as high-band excitation signal 202 of FIG. 2) by extending a spectrum of the low-band excitation signal 144 into the high-band frequency range (e.g., 7 kHz-16 kHz). To illustrate, the high-band excitation generator 152 may apply a transform (e.g., a non-linear transform such as an absolute-value or square operation) to the low-band excitation signal 144 and may mix the transformed low-band excitation signal with a noise signal (e.g., white noise modulated or shaped according to an envelope corresponding to the low-band excitation signal 144 that mimics slow varying temporal characteristics of the low-band signal 122) to generate the high-band excitation signal. For example, the mixing may be performed according to the following equation:

$$\text{High-band excitation}=(\alpha*\text{transformed low-band excitation})+((1-\alpha)*\text{modulated noise})$$

A ratio at which the transformed low-band excitation signal and the modulated noise are mixed may impact high-band reconstruction quality at a receiver. For voiced speech signals, the mixing may be biased towards the transformed low-band excitation (e.g., the mixing factor $\alpha$ may be in the range of 0.5 to 1.0). For unvoiced signals, the mixing may be biased towards the modulated noise (e.g., the mixing factor $\alpha$ may be in the range of 0.0 to 0.5).

The high-band excitation signal may be used to determine one or more high-band gain parameters that are included in the high-band side information 172. In a particular embodiment, the high-band excitation signal and the high-band signal 124 may be used to determine scaling information (e.g., scaling factors) that are applied to the high-band excitation signal to determine a scaled high-band excitation signal. The scaled high-band excitation signal may be used to determine the high-band gain parameters. For example, as described further with reference to FIGS. 2 and 5-7, the energy estimator 154 may determine estimated energy of frames or sub-frames of the high-band signal and of corresponding frames or sub-frames of a first modeled high band signal. The first modeled high band signal may be determined by applying memoryless linear prediction synthesis on the high-band excitation signal. The scaling module 156 may determine scaling factors (e.g., a first set of scaling factors) based on the estimated energy of frames or sub-frames of the high-band signal 124 and the estimated energy of the corresponding frames or sub-frames of a first modeled high band signal. For example, each scaling factor may correspond to a ratio $E_i/E_i'$, where $E_i$ is an estimated energy of a sub-frame, i, of the high-band signal and $E_i'$ is an estimated energy of a corresponding sub-frame, i, of the first modeled high band signal. The scaling module 156 may also apply the scaling factors (or a second set of scaling factors determined based on the first set of scaling factors, e.g., by averaging gains over several subframes of the first set of scaling factors), on a sub-frame-by-sub-frame basis, to the high-band excitation signal to determine the scaled high-band excitation signal.

As illustrated, the high-band analysis module 150 may also include an LP analysis and coding module 158, a LPC to LSP transform module 160, and a quantizer 162. Each of the LP analysis and coding module 158, the transform module 160, and the quantizer 162 may function as described above with reference to corresponding components of the low-band analysis module 130, but at a comparatively reduced resolution (e.g., using fewer bits for each coefficient, LSP, etc.). The LP analysis and coding module 158 may generate a set of LPCs that are transformed to LSPs by the transform module 160 and quantized by the quantizer 162 based on a codebook 166. For example, the LP analysis and coding module 158, the transform module 160, and the quantizer 162 may use the high-band signal 124 to determine high-band filter information (e.g., high-band LSPs) that is included in the high-band side information 172. In a particular embodiment, the high-band side information 172 may include high-band LSPs, high-band gain information, the scaling factors, or a combination thereof. As explained above, the high-band gain information may be determined based on a scaled high-band excitation signal.

The low-band bit stream 142 and the high-band side information 172 may be multiplexed by a multiplexer (MUX) 180 to generate an output data stream or output bit stream 192. The output bit stream 192 may represent an encoded audio signal corresponding to the input audio signal 102. For example, the output bit stream 192 may be transmitted (e.g., over a wired, wireless, or optical channel) and/or stored. At a receiver, reverse operations may be performed by a demultiplexer (DEMUX), a low-band decoder, a high-band decoder, and a filter bank to generate an audio signal (e.g., a reconstructed version of the input audio signal 102 that is provided to a speaker or other output device). The number of bits used to represent the low-band bit stream 142 may be substantially larger than the number of bits used to represent the high-band side information 172. Thus, most of the bits in the output bit stream 192 may represent low-band data. The high-band side information 172 may be used at a receiver to regenerate the high-band excitation signal from the low-band data in accordance with a signal model. For example, the signal model may represent an expected set of relationships or correlations between low-band data (e.g., the low-band signal 122) and high-band data (e.g., the high-band signal 124). Thus, different signal models may be used for different kinds of audio data (e.g., speech, music, etc.), and the particular signal model that is in use may be negotiated by a transmitter and a receiver (or defined by an industry standard) prior to communication of encoded audio data. Using the signal model, the high-band analysis module 150 at a transmitter may be able to generate the high-band side information 172 such that a corresponding high-band analysis module at a receiver is able to use the signal model to reconstruct the high-band signal 124 from the output bit stream 192.

Figure 2:
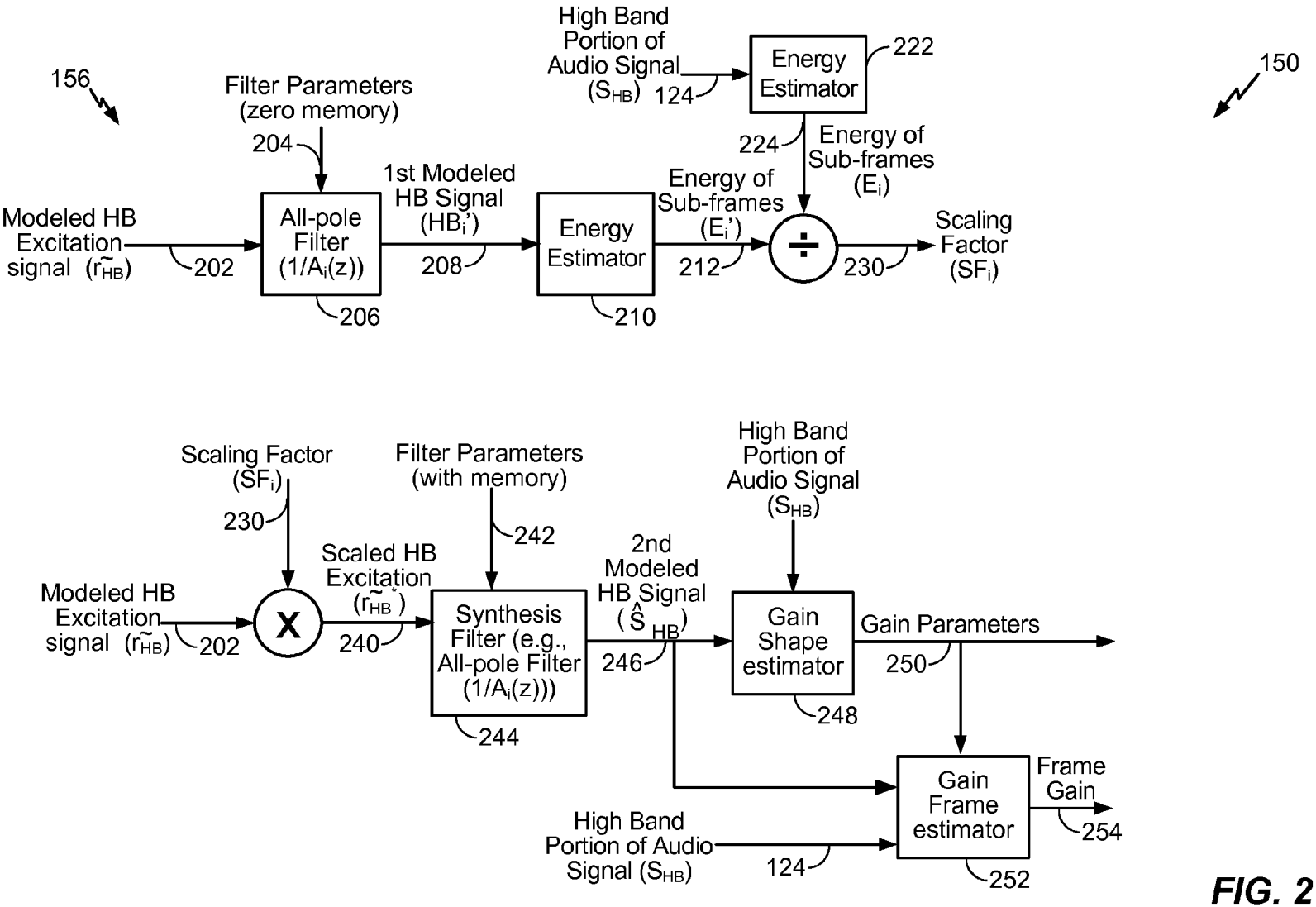
FIG. 2 is a diagram to illustrate a particular embodiment of a high-band analysis module of FIG. 1.

FIG. 2 is a diagram illustrating a particular embodiment of the high-band analysis module 150 of FIG. 1. The high-band analysis module 150 is configured to receive a high-band excitation signal 202 and a high-band portion of an audio signal (e.g., the high-band signal 124) and to generate gain information, such as gain parameters 250 and frame gain 254, based on the high-band excitation signal 202 and the high-band signal 124. The high-band excitation signal 202 may correspond to the high-band excitation signal generated by the high-band excitation generator 152 using the low-band excitation signal 144.

Filter parameters 204 may be applied to the high-band excitation signal 202 using an all-pole LP synthesis filter 206 (e.g., a synthesis filter) to determine a first modeled high-band signal 208. The filter parameters 204 may correspond to the feedback memory of the all-pole LP synthesis filter 206. For purposes of determining the scaling factors, the filter parameters 204 may be memoryless. In particular, the filter memory or filter states that are associated with the i-th subframe LP synthesis filter, $1/A_i(z)$ are reset to zero before carrying out the all-pole LP synthesis filter 206.

The first modeled high-band signal 208 may be applied to an energy estimator 210 to determine sub-frame energy 212 of each frame or sub-frame of the first modeled high-band signal 208. The high-band signal 124 may also be applied to an energy estimator 222 to determine energy 224 of each frame or sub-frame of the high-band signal 124. The sub-frame energy 212 of the first modeled high-band signal 208 and the energy 224 of the high-band signal 124 may be used to determine scaling factors 230. The scaling factors 230 may quantify energy differences between frames or sub-frames of the first modeled high-band signal 208 and corresponding frames or sub-frames of the high-band signal 124. For example, the scaling factors 230 may be determined as a ratio of energy 224 of the high-band signal 124 and the estimated sub-frame energy 212 of the first modeled high-band signal 208. In a particular embodiment, the scaling factors 230 are determined on a sub-frame-by-sub-frame basis, where each frame includes four sub-frames. In this embodiment, one scaling factor is determined for each set of sub-frames including a sub-frame of the first modeled high-band signal 208 and a corresponding sub-frame of the high-band signal 124.

To determine the gain information, each sub-frame of the high-band excitation signal 202 may be compensated (e.g., multiplied) with a corresponding scaling factor 230 to generate a scaled high-band excitation signal 240. Filter parameters 242 may be applied to the scaled high-band excitation signal 240 using an all-pole filter 244 to determine a second modeled high-band signal 246. The filter parameters 242 may correspond to parameters of a linear prediction analysis and coding module, such as the LP analysis and coding module 158 of FIG. 1. For purposes of determining the gain information, the filter parameters 242 may include information associated with previously processed frames (e.g., filter memory).

The second modeled high-band signal 246 may be applied to a gain shape estimator 248 along with the high-band signal 124 to determine gain parameters 250. The gain parameters 250, the second modeled high-band signal 246 and the high-band signal 124 may be applied to a gain frame estimator 252 to determine a frame gain 254. The gain parameters 250 and the frame gain 254 together form the gain information. The gain information may have reduced dynamic range relative to gain information determined without applying the scaling factors 230 since the scaling factors account for some of the energy differences between the high-band signal 124 and the second modeled high-band signal 246 determined based on the high-band excitation signal 202.

Figure 3:
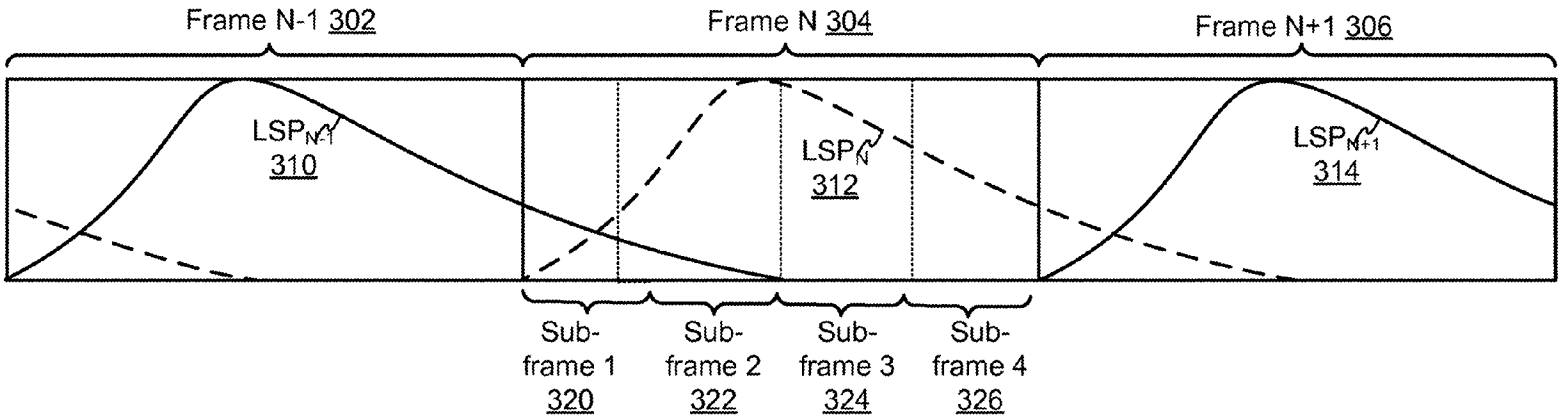
FIG. 3 is a diagram to illustrate a particular embodiment of interpolating sub-frame information.

FIG. 3 is a diagram illustrating a particular embodiment of interpolating sub-frame information. The diagram of FIG. 3 illustrates a particular method of determining sub-frame information for an Nth Frame 304. The Nth Frame 304 is preceded in a sequence of frames by an N−1th Frame 302 and is followed in the sequence of frames by an N+1th Frame 306. A LSP is calculated for each frame. For example, an N−1th LSP 310 is calculated for the N−1th Frame 302, an Nth LSP 312 is calculated for the Nth Frame 304, and an N+1th LSP 314 is calculated for the N+1th Frame 306. The LSPs may represent the spectral evolution of the high-band signal, $S_{HB}$ 124, 502 of FIG. 1, 2, or 5-7.

A plurality of sub-frame LSPs for the Nth Frame 304 may be determined by interpolation using LSP values of a preceding frame (e.g., the N−1th Frame 302) and a current frame (e.g., the Nth Frame 304). For example, weighting factors may be applied to values of a preceding LSP (e.g., the N−1th LSP 310) and to values of a current LSP (e.g., the Nth LSP 312). In the example illustrated in FIG. 3, LSPs for four sub-frames (including a first sub-frame 320, a second sub-frame 322, a third sub-frame 324, and a fourth sub-frame 326) are calculated. The four sub-frame LSPs 320-326 may be calculated using equal weighting or unequal weighting.

The sub-frame LSPs (320-326) may be used to perform the LP synthesis without filter memory updates to estimate the first modeled high band signal 208. The first modeled high band signal 208 is then used to estimate sub-frame energy $E_i'$ 212. The energy estimator 154 may provide sub-frame energy estimates for the first modeled high-band signal 208 and for the high-band signal 124 to the scaling module 156, which may determine sub-frame-by-sub-frame scaling factors 230. The scaling factors may be used to adjust an energy level of the high-band excitation signal 202 to generate a scaled high-band excitation signal 240, which may be used by the LP analysis and coding module 158 to generate a second modeled (or synthesized) high-band signal 246. The second modeled high-band signal 246 may be used to generate gain information (such as the gain parameters 250 and/or the frame gain 254). For example, the second modeled high-band signal 246 may be provided to the gain estimator 164, which may determine the gain parameters 250 and frame gain 254.

Figure 4:
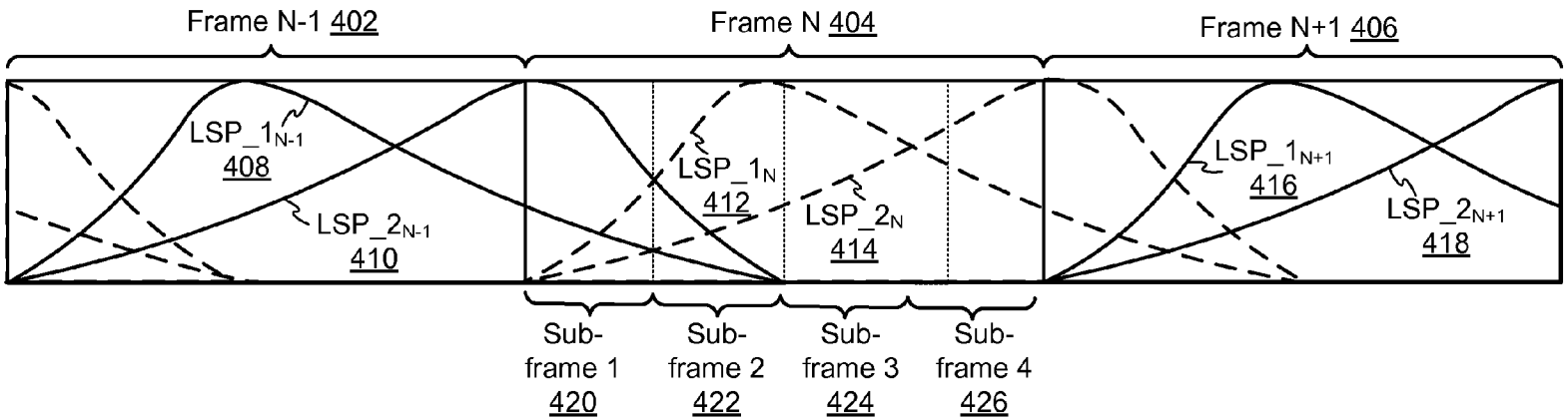
FIG. 4 is a diagram to illustrate another particular embodiment of interpolating sub-frame information.

FIG. 4 is a diagram illustrating another particular embodiment of interpolating sub-frame information. The diagram of FIG. 4 illustrates a particular method of determining sub-frame information for an Nth Frame 404. The Nth Frame 404 is preceded in a sequence of frames by an N−1th Frame 402 and is followed in the sequence of frames by an N+1th Frame 406. Two LSPs are calculated for each frame. For example, an LSP_1 408 and an LSP_2 410 are calculated for the N−1th Frame 402, an LSP_1 412 and an LSP_2 414 are calculated for the Nth Frame 404, and an LSP_1 416 and an LSP_2 418 are calculated for the N+1th Frame 406. The LSPs may represent the spectral evolution of the high-band signal, $S_{HB}$ 124, 502 of FIG. 1, 2, or 5-7.

A plurality of sub-frame LSPs for the Nth Frame 404 may be determined by interpolation using one or more of the LSP values of a preceding frame (e.g., the LSP_1 408 and/or the LSP_2 410 of the N−1th Frame 402) and one or more of the LSP values of a current frame (e.g., the Nth Frame 404). While the LSP windows (e.g., dashed lines 412, 414 asymmetric LSP windows for Frame N 404) shown in FIG. 4 is for illustrative purposes, it is possible to adjust the LP analysis windows such that the overlap within or across frames (with look-ahead) may improve the spectral evolution of the estimated LSPs from frame-to-frame or subframe-to-subframe. For example, weighting factors may be applied to values of a preceding LSP (e.g., the LSP_2 410) and to LSP values of the current frame (e.g., the LSP_1 412 and/or the LSP_2 414). In the example illustrated in FIG. 4, LSPs for four sub-frames (including a first sub-frame 420, a second sub-frame 422, a third sub-frame 424, and a fourth sub-frame 426) are calculated. The four sub-frame LSPs 420-426 may be calculated using equal weighting or unequal weighting.

The sub-frame LSPs (420-426) may be used to perform the LP synthesis without filter memory updates to estimate the first modeled high band signal 208. The first modeled high band signal 208 is then used to estimate sub-frame energy $E_i'$ 212. The energy estimator 154 may provide sub-frame energy estimates for the first modeled high-band signal 208 and for the high-band signal 124 to the scaling module 156, which may determine sub-frame-by-sub-frame scaling factors 230. The scaling factors may be used to adjust an energy level of the high-band excitation signal 202 to generate a scaled high-band excitation signal 240, which may be used by the LP analysis and coding module 158 to generate a second modeled (or synthesized) high-band signal 246. The second modeled high-band signal 246 may be used to generate gain information (such as the gain parameters 250 and/or the frame gain 254). For example, the second modeled high-band signal 246 may be provided to the gain estimator 164, which may determine the gain parameters 250 and frame gain 254.

FIGS. 5-7 are diagrams that collectively illustrate another particular embodiment of a high-band analysis module, such as the high-band analysis module 150 of FIG. 1. The high-band analysis module is configured to receive a high-band signal 502 at an energy estimator 504. The energy estimator 504 may estimate energy of each sub-frame of the high-band signal. The estimated energy 506, of each sub-frame of the high-band signal 502 may be provided to a quantizer 508, which may generate high-band energy indices 510.

The high-band signal 502 may also be received at a windowing module 520. The windowing module 520 may generate linear prediction coefficients (LPCs) for each pair of frames of the high-band signal 502. For example, the windowing module 520 may generate a first LPC 522 (e.g., LPC_1). The windowing module 520 may also generate a second LPC 524 (e.g., LPC_2). The first LPC 522 and the second LPC 524 may each be transformed to LSPs using LSP transform modules 526 and 528. For example, the first LPC 522 may be transformed to a first LSP 530 (e.g. LSP_1), and the second LPC 524 may be transformed to a second LSP 532 (e.g. LSP_2). The first and second LSPs 530, 532 may be provided to a coder 538, which may encode the LSPs 530, 532 to form high-band LSP indices 540.

The first and second LSPs 530, 532 and a third LSP 534 (e.g., LSP_$2_{old}$) may be provided to an interpolator 536. The third LSP 534 may correspond to a previously processed frame, such as the N−1th Frame 302 of FIG. 3 (when sub-frames of the Nth Frame 304 are being determined). The interpolator 536 may use the first, second and third LSPs 530, 532 and 534 to generate interpolated sub-frame LSPs 542, 544, 546, and 548. For example, the interpolator 536 may apply weightings to the LSPs 530, 532 and 534 to determine the sub-frame LSPs 542, 544, 546, and 548.

The sub-frame LSPs 542, 544, 546, and 548 may be provided to an LSP-to-LPC transformation module 550 to determine sub-frame LPCs and filter parameters 552, 554, 556, and 558.

As also illustrated in FIG. 5, a high-band excitation signal 560 (e.g., a high-band excitation signal determined by the high-band excitation generator 152 of FIG. 1 based on the low-band excitation signal 144) may be provided to a sub-framing module 562. The sub-framing module 562 may parse the high-band excitation signal 560 into sub-frames 570, 572, 574, and 576 (e.g., four sub-frames per frame of the high-band excitation signal 560).

Referring to FIG. 6, the filter parameters 552, 554, 556, and 558 from the LSP-to-LPC transformation module 550 and the sub-frames 570, 572, 574, 576 of the high-band excitation signal 560 may be provided to corresponding all-pole filters 612, 614, 616, 618. Each of the all-pole filters 612, 614, 616, 618 may generate sub-frames 622, 624, 626, 628 of a first modeled (or synthesized) high-band signal ($HB_i'$, where i is an index of a particular sub-frame) of a corresponding sub-frame 570, 572, 574, 576 of the high-band excitation signal 560. In a particular embodiment, for purposes of determining scaling factors, such as scaling factors 672, 674, 676, and 678, the filter parameters 552, 554, 556, and 558 may be memoryless. That is, in order to generate a first sub-frame 622 of a first modeled high-band signal, the LP synthesis, $1/A_1(z)$, is performed with its filter parameters 552 (e.g., filter memory or filter states) reset to zero.

The sub-frames 622, 624, 626, 628 of the first modeled high-band signal may be provided to energy estimators 632, 634, 636, and 638. The energy estimators 632, 634, 636, and 638 may generate energy estimates 642, 644, 646, 648 ($E_i'$, where i is an index of a particular sub-frame) of the sub-frames 622, 624, 626, 628 of the first modeled high-band signal.

The energy estimates 652, 654, 656, and 658 of the high-band signal 502 of FIG. 5 may be combined with (e.g., divided by) the energy estimates 642, 644, 646, 648 of the sub-frames 622, 624, 626, 628 of the first modeled high-band signals to form the scaling factors 672, 674, 676, and 678. In a particular embodiment, each scaling factor is a ratio of energy of a sub-frame of the high-band signal, $E_i$, to that of the energy of a corresponding sub-frame 622, 624, 626, 628 of the first modeled high-band signal, $E_i'$. For example, a first scaling factor 672 ($SF_1$) may be determined as a ratio of $E_1$ 652 divided by $E_1'$642. Thus, the first scaling factor 672 numerically represents a relationship between energy of the first sub-frame of the high band signal 502 of FIG. 5 and the first sub-frame 622 of the first modeled high-band signal determined based on the high-band excitation signal 560.

Referring to FIG. 7, each sub-frame 570, 572, 574, 576 of the high-band excitation signal 560 may be combined (e.g., multiplied) with a corresponding scaling factor 672, 674, 676, and 678 to generate a sub-frame 702, 704, 706, and 708 of a scaled high-band excitation signal ($\tilde{r}_{HB_i}$*, where i is an index of a particular sub-frame). For example, the first sub-frame 570 of the high-band excitation signal 560 may be multiplied by the first scaling factor 672 to generate a first sub-frame 702 of the scaled high-band excitation signal.

The sub-frames 702, 704, 706, and 708 of the scaled high-band excitation signal may be applied to all-pole filters 712, 714, 716, 718 (e.g., synthesis filters) to determine sub-frames 742, 744, 746, 748 of a second modeled (or synthesized) high-band signal. For example, the first sub-frame 702 of the scaled high-band excitation signal may be applied to a first all-pole filter 712, along with first filter parameters 722, to determine a first sub-frame 742 of the second modeled high-band signal. Filter parameters 722, 724, 726, and 728 applied to the all-pole filters 712, 714, 716, 718 may include information related to previously processed frames (or sub-frames). For example, each all-pole filter 712, 714, 716 may output filter state update information 732, 734, 736 that is provided to another of the all-pole filters 714, 716, 718. The filter state update 738 from the all-pole filter 718 may be used in the next frame (i.e., first sub-frame) to update the filter memory.

The sub-frames 742, 744, 746, 748 of the second modeled high-band signal may be combined, at a framing module 750, to generate a frame 752 of the second modeled high-band signal. The frame 752 of the second modeled high-band signal may be applied to a gain shape estimator 754 along with the high-band signal 502 to determine gain parameters 756. The gain parameters 756, the frame 752 of the second modeled high-band signal, and the high-band signal 502 may be applied to a gain frame estimator 758 to determine a frame gain 760. The gain parameters 756 and the frame gain 760 together form gain information. The gain information may have reduced dynamic range relative to gain information determined without applying the scaling factors 672, 674, 676, 678 since the scaling factors 672, 674, 676, 678 account for some of the energy differences between the high-band signal 502 and a signal modeled using the high-band excitation signal 560.

FIG. 8 is a flowchart illustrating a particular embodiment of a method of audio signal processing designated 800. The method 800 may be performed at a high-band analysis module, such as the high-band analysis module 150 of FIG. 1. The method 800 includes, at 802, determining a first modeled high-band signal based on a low-band excitation signal of an audio signal. The audio signal includes a high-band portion and a low-band portion. For example, the first modeled high-band signal may correspond to the first modeled high-band signal 208 of FIG. 2 or to a set of sub-frames 622, 624, 626, 628 of the first modeled high-band signal of FIG. 6. The first modeled high-band signal may be determined using linear prediction analysis by applying a high-band excitation signal to an all-pole filter with memoryless filter parameters. For example, the high-band excitation signal 202 may be applied to the all-pole LP synthesis filter 206 of FIG. 2. In this example, the filter parameters 204 applied to the all-pole LP synthesis filter 206 are memoryless. That is, the filter parameters 204 relate the particular frame or sub-frame of the high-band excitation signal 202 that is being processed and do not include information related to previously processed frames or sub-frames. In another example, the sub-frames 570, 572, 574, 576 of the high-band excitation signal 560 of FIGS. 5 and 6 may be applied to the corresponding all-pole filters 612, 614, 616, 618. In this example, the filter parameters 552, 554, 556, 558 applied to each of the all-pole filters 612, 614, 616, 618 are memoryless.

The method 800 also includes, at 804, determining scaling factors based on energy of sub-frames of the first modeled high-band signal and energy of corresponding sub-frames of the high-band portion of the audio signal. For example, the scaling factors 230 of FIG. 2 may be determined by dividing estimated energy 224 of a sub-frame of the high-band signal 124 by estimated sub-frame energy 212 of a corresponding sub-frame of the first modeled high-band signal 208. In another example, the scaling factors 672, 674, 676, 678 of FIG. 6 may be determined by dividing the estimated energy 652, 654, 656, 658 of a sub-frame of the high-band signal 502 by the estimated energy 642, 644, 646, 648 of a corresponding sub-frame 622, 624, 626, 628 of the first modeled high-band signal.

The method 800 includes, at 806, applying the scaling factors to a modeled high-band excitation signal to determine a scaled high-band excitation signal. For example, the scaling factor 230 of FIG. 2 may be applied to the high-band excitation signal 202, on a sub-frame-by-sub-frame basis, to generate the scaled high-band excitation signal. In another example, the scaling factors 672, 674, 676, 678 of FIG. 6 may be applied to the corresponding sub-frames 570, 572, 574, 576 of the high-band excitation signal 560 to generate the sub-frames 702, 704, 706, 708 of the scaled high-band excitation signal. In a particular embodiment, a first set of one or more scaling factors may be determined at 804, and a second set of one or more scaling factors may be applied to the modeled high-band excitation signal at 806. The second set of one or more scaling factors may be determined based on the first set of one or more scaling factors. For example, gains associated with multiple sub-frames used to determine the first set of one or more scaling factors may be averaged to determine the second set of one or more scaling factors. In this example, the second set of one or more scaling factors may include fewer scaling factors that does the first set of one or more scaling factors.

The method 800 includes, at 808, determining a second modeled high-band signal based on the scaled high-band excitation signal. To illustrate, linear prediction analysis of the scaled high-band excitation signal may be performed. For example, the scaled high-band excitation signal 240 of FIG. 2 may be applied to the all-pole filter 244 with the filter parameters 242 to determine the second modeled (e.g., synthesized) high-band signal 246. The filter parameters 242 may include memory (e.g., may be updated based on previously processed frames or sub-frames). In another example, the sub-frames 702, 704, 706, 708 of the scaled high-band excitation signal of FIG. 7 may be applied to the all-pole filters 712, 714, 716, 718 with the filter parameters 722, 724, 726, 728 to determine the sub-frames 742, 744, 746, 748 of the second modeled (e.g., synthesized) high-band signal. The filter parameters 722, 724, 726, 728 may include memory (e.g., may be updated based on previously processed frames or sub-frames).

The method 800 includes, at 810, determining gain parameters based on the second modeled high-band signal and the high-band portion of the audio signal. For example, the second modeled high-band signal 246 and the high-band signal 124 may be provided to the gain shape estimator 248 of FIG. 2. The gain shape estimator 248 may determine the gain parameters 250. Additionally, the second modeled high-band signal 246, the high-band signal 124, and the gain parameters 250 may be provided to the gain frame estimator 252, which may determine the frame gain 254. In another example, the sub-frames 742, 744, 746, 748 of the second modeled high-band signal may be used to form a frame 752 of the second modeled high-band signal. The frame 752 of the second modeled high-band signal and a corresponding frame of the high-band signal 502 may be provided to the gain shape estimator 754 of FIG. 7. The gain shape estimator 754 may determine the gain parameters 756. Additionally, the frame 752 of the second modeled high-band signal, the corresponding frame of the high-band signal 502, and the gain parameters 756 may be provided to the gain frame estimator 758, which may determine the frame gain 760. The frame gain and gain parameters may be included in high-band side information, such as the high-band side information 172 of FIG. 1, that is included in a bit stream 192 used to encode an audio signal, such as the audio signal 102.

FIGS. 1-8 thus illustrate examples including systems and methods that perform audio signal encoding in a manner that uses scaling factors to account for energy differences between a high-band portion of an audio signal, such as the high-band signal 124 of FIG. 1, and a modeled or synthesized version of the high-band signal that is based on a low-band excitation signal, such as the low-band excitation signal 144. Using the scaling factors to account for the energy differences may improve calculation of gain information, e.g., by reducing a dynamic range of the gain information. The systems and methods of FIGS. 1-8 may be integrated into and/or performed by one or more electronic devices, such as a mobile phone, a hand-held personal communication systems (PCS) unit, a communications device, a music player, a video player, an entertainment unit, a set top box, a navigation device, a global positioning system (GPS) enabled device, a PDA, a computer, a portable data unit (such as a personal data assistant), a fixed location data unit (such as meter reading equipment), or any other device that performs audio signal encoding and/or decoding functions.

Referring to FIG. 9, a block diagram of a particular illustrative embodiment of a wireless communication device is depicted and generally designated 900. The device 900 includes at least one processor coupled to a memory 932. For example, in the embodiment illustrated in FIG. 9, the device 900 includes a first processor 910 (e.g., a central processing unit (CPU)) and a second processor 912 (e.g., a DSP, etc.). In other embodiments, the device 900 may include only a single processor, or may include more than two processors. The memory 932 may include instructions 960 executable by at least one of the processors 910, 912 to perform methods and processes disclosed herein, such as the method 700 of FIG. 8 or one or more of the processes described with reference to FIGS. 1-7.

For example, the instructions 960 may include or correspond to a low-band analysis module 976 and a high-band analysis module 978. In a particular embodiment, the low-band analysis module 976 corresponds to the low-band analysis module 130 of FIG. 1, and the high-band analysis module 978 corresponds to the high-band analysis module 150 of FIG. 1. Additionally, or in the alternative, the high-band analysis module 978 may correspond to or include a combination of components of FIG. 2 or 5-7.

In various embodiments, the low-band analysis module 976, the high-band analysis module 978, or both, may be implemented via dedicated hardware (e.g., circuitry), by a processor (e.g., the processor 912) executing the instructions 960 or instructions 961 in a memory 980 to perform one or more tasks, or a combination thereof. As an example, the memory 932 or the memory 980 may include or correspond to a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 960 or the instructions 961) that, when executed by a computer (e.g., the processor 910 and/or the processor 912), may cause the computer to determine scaling factors based on energy of sub-frames of a first modeled high-band signal and energy of corresponding sub-frames of a high-band portion of an audio signal, apply the scaling factors to a modeled high-band excitation signal to determine a scaled high-band excitation signal, determine a second modeled high-band signal based on the scaled high-band excitation signal, and determine gain parameters based on the second modeled high-band signal and the high-band portion of the audio signal. As an example, the memory 932 or the memory 980 may be a non-transitory computer-readable medium that includes instructions that, when executed by a computer (e.g., the processor 910 and/or the processor 912), cause the computer perform at least a portion of the method 800 of FIG. 8.

FIG. 9 also shows a display controller 926 that is coupled to the processor 910 and to a display 928. A CODEC 934 may be coupled to the processor 912, as shown, to the processor 910, or both. A speaker 936 and a microphone 938 can be coupled to the CODEC 934. For example, the microphone 938 may generate the input audio signal 102 of FIG. 1, and the processor 912 may generate the output bit stream 192 for transmission to a receiver based on the input audio signal 102. As another example, the speaker 936 may be used to output a signal reconstructed from the output bit stream 192 of FIG. 1, where the output bit stream 192 is received from a transmitter. FIG. 9 also indicates that a wireless controller 940 can be coupled to the processor 910, to the processor 912, or both, and to an antenna 942. In a particular embodiment, the CODEC 934 is an analog audio-processing front-end component. For example, the CODEC 934 may perform analog gain adjustment and parameter setting for signals received from the microphone 938 and signals transmitted to the speaker 936. The CODEC 934 may also include analog-to-digital (A/D) and digital-to-analog (D/A) converters. In a particular example, the CODEC 934 also includes one or more modulators and signal processing filters. The CODEC 934 may include a memory to buffer input data received from the microphone 938 and to buffer output data that is to be provided to the speaker 936.

In a particular embodiment, the processor 910, the processor 912, the display controller 926, the memory 932, the CODEC 934, and the wireless controller 940 are included in a system-in-package or system-on-chip device 922. In a particular embodiment, an input device 930, such as a touch screen and/or keypad, and a power supply 944 are coupled to the system-on-chip device 922. Moreover, in a particular embodiment, as illustrated in FIG. 9, the display 928, the input device 930, the speaker 936, the microphone 938, the antenna 942, and the power supply 944 are external to the system-on-chip device 922. However, each of the display 928, the input device 930, the speaker 936, the microphone 938, the antenna 942, and the power supply 944 can be coupled to a component of the system-on-chip device 922, such as an interface or a controller.

In conjunction with the described embodiments, an apparatus is disclosed that includes means for determining a first modeled high-band signal based on a low-band excitation signal of an audio signal, where the audio signal includes a high-band portion and a low-band portion. For example, the high-band analysis module 150 (or a component thereof, such as the LP analysis and coding module 158) may determine the first modeled high-band signal based on the low-band excitation signal 144 of the audio signal 102. As another example, a first synthesis filter, such as the all-pole LP synthesis filter 206 of FIG. 2 may determine the first modeled high-band signal 208 based on the high-band excitation signal 202. The high-band excitation signal 202 may be determined by the high-band excitation generator 152 of FIG. 1 based on the low-band excitation signal 144) of an audio signal. As yet another example, a set of first synthesis filters, such as the all-pole filters 612, 614, 616, 618 of FIG. 6 may determine the sub-frames 622, 624, 626, 628 of the first modeled high-band signal based on the sub-frames 570, 572, 574, 576 of the high-band excitation signal. As still another example, the processor 910 of FIG. 9, the processor 912, or a component of one of the processors 910, 912 (such as the high-band analysis module 978 or the instructions 961) may determine the first modeled high-band signal based on the low-band excitation signal.

The apparatus also includes means for determining scaling factors based on energy of sub-frames of the first modeled high-band signal and energy of corresponding sub-frames of the high-band portion of the audio signal. For example, the energy estimator 154 and the scaling module 156 of FIG. 1 may determine the scaling factors. In another example, the scaling factors 230 may be determined based on estimated sub-frame energy 212 and 224 of FIG. 2. In yet another example, the scaling factors 672, 674, 676, 678 may be determined based on estimated energy 642, 644, 646, 648 and estimated energy 652, 654, 656, 658, respectively, of FIG. 6. As still another example, the processor 910 of FIG. 9, the processor 912, or a component of one of the processors 910, 912 (such as the high-band analysis module 978 or the instructions 961) may determine the scaling factors.

The apparatus also includes means for applying the scaling factors to a modeled high-band excitation signal to determine a scaled high-band excitation signal. For example, the scaling module 156 of FIG. 1 may apply the scaling factors to the modeled high-band excitation signal to determine the scaled high-band excitation signal. In another example, a combiner (e.g., a multiplier) may apply the scaling factors 230 to the modeled high-band excitation signal 202 to determine the scaled high-band excitation signal 240 of FIG. 2. In yet another example, combiners (e.g., multipliers) may apply the scaling factors 672, 674, 676, 678 to corresponding sub-frames 570, 572, 574, 576, of the high-band excitation signal to determine the sub-frames 702, 704, 706, 708 of the scaled high-band excitation signal of FIG. 7. As still another example, the processor 910 of FIG. 9, the processor 912, or a component of one of the processors 910, 912 (such as the high-band analysis module 978 or the instructions 961) may apply the scaling factors to a modeled high-band excitation signal to determine a scaled high-band excitation signal.

The device also includes means for determining a second modeled high-band signal based on the scaled high-band excitation signal. For example, the high-band analysis module 150 (or a component thereof, such as the LP analysis and coding module 158) may determine the second modeled high-band signal based on the scaled high-band excitation signal. As another example, a second synthesis filter, such as the all-pole filter 244 of FIG. 2, may determine the second modeled high-band signal 246 based on the scaled high-band excitation signal 240. As yet another example, a set of second synthesis filters, such as the all-pole filters 712, 714, 716, 718 of FIG. 7 may determine the sub-frames 742, 744, 746, 748 of the second modeled high-band signal based on the sub-frames 702, 704, 706, 708 of the scaled high-band excitation signal. As still another example, the processor 910 of FIG. 9, the processor 912, or a component of one of the processors 910, 912 (such as the high-band analysis module 978 or the instructions 961) may determine the second modeled high-band signal based on the scaled high-band excitation signal.

The apparatus also includes means for determining gain parameters based on the second modeled high-band signal and the high-band portion of the audio signal. For example, the gain estimator 164 of FIG. 1 may determine the gain parameters. In another example, the gain shape estimator 248, the gain frame estimator 252, or both, may determine gain information, such as the gain parameters 250 and the frame gain 254. In yet another example, the gain shape estimator 754, the gain frame estimator 758, or both, may determine gain information, such as the gain parameters 756 and the frame gain 760. As still another example, the processor 910 of FIG. 9, the processor 912, or a component of one of the processors 910, 912 (such as the high-band analysis module 978 or the instructions 961) may determine the gain parameters based on the second modeled high-band signal and the high-band portion of the audio signal.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as RAM, MRAM, STT-MRAM, flash memory, ROM, PROM, EPROM, EEPROM, registers, hard disk, a removable disk, or a CD-ROM. An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A method comprising:

determining a first modeled high-band signal based on a low-band excitation signal of an audio signal, the audio signal including a high-band portion and a low-band portion;

determining a first set of one or more scaling factors based on energy of sub-frames of the first modeled high-band signal and energy of corresponding sub-frames of the high-band portion of the audio signal;

applying a second set of one or more scaling factors based on at least one among the first set of one or more scaling factors to a modeled high-band excitation signal to determine a scaled high-band excitation signal;

determining a second modeled high-band signal based on the scaled high-band excitation signal;

determining gain parameters based on the second modeled high-band signal and the high-band portion of the audio signal; and outputting a data stream based on the determined gain parameters.

2. The method of claim 1, wherein a particular sub-frame of the first modeled high-band signal is determined by applying a synthesis filter on a particular sub-frame of the modeled high-band excitation signal.

3. The method of claim 2, wherein the synthesis filter uses filter parameters corresponding to the particular sub-frame of the modeled high-band excitation signal.

4. The method of claim 3, wherein a filter memory or filter states are reset to zero before applying the synthesis filter on the particular sub-frame of the modeled high-band excitation signal.

5. The method of claim 3, wherein the filter parameters do not include information related to sub-frames preceding the particular sub-frame of the modeled high-band excitation signal.

6. The method of claim 1, wherein a particular sub-frame of the second modeled high-band signal is determined by applying a synthesis filter on a particular sub-frame of the scaled high-band excitation signal that corresponds to the particular sub-frame of the second modeled high-band signal.

7. The method of claim 6, wherein the synthesis filter uses a filter memory or updates filter states based on the particular sub-frame of the scaled high-band excitation signal and one or more preceding sub-frames.

8. The method of claim 7, wherein the filter memory or the filter states are not reset to zero and are carried over from a previous frame or sub-frame before applying the synthesis filter on the particular sub-frame of the scaled high-band excitation signal.

9. The method of claim 1, further comprising estimating the energy of one or more of the sub-frames of the first modeled high band signal that is synthesized based on all-pole synthesis filters, wherein the all-pole synthesis filters have filter coefficients that are interpolated based on a weighted sum of one or more line spectral pairs associated with a current frame and of one or more line spectral pairs associated with a preceding frame.

10. The method of claim 1, wherein determining a scaling factor for a particular sub-frame comprises:

determining an energy of the particular sub-frame of the high-band portion of the audio signal;

determining an energy of a corresponding sub-frame of the first modeled high-band signal;

dividing the energy of the particular sub-frame of the high-band portion of the audio signal by the energy of the corresponding sub-frame of the first modeled high-band signal; and quantizing and transmitting the scaling factor.

11. The method of claim 10 wherein the first set of one or more scaling factors are determined over each sub-frame or over each frame constituting multiple sub-frames.

12. The method of claim 1, wherein the gain parameters include a gain shape and a gain frame; and further comprising determining the modeled high-band excitation signal by combining a transformed low-band excitation signal with a shaped noise signal.

13. The method of claim 12, further comprising determining the low-band excitation signal based on linear prediction coding of the low-band portion of the audio signal.

14. The method of claim 1, further comprising determining high-band side information, the high-band side information including data representing high-band line spectral pairs, data representing the gain parameters, data representing a scaling factor, or a combination thereof.

15. The method of claim 1, wherein: determining the first modeled high-band signal; determining the first set of the one or more scaling factors; applying the second set of the one or more scaling factors; determining the second modeled high-band signal; determining the gain parameters; and outputting the data stream are performed within a device that comprises a mobile communication device or a fixed communication unit.

16. An apparatus comprising:

a first synthesis filter configured to determine a first modeled high-band signal based on a low-band excitation signal of an audio signal, the audio signal including a high-band portion and a low-band portion;

a scaling module configured to determine scaling factors based on energy of sub-frames of the first modeled high-band signal and energy of corresponding sub-frames of the high-band portion of the audio signal and to apply the scaling factors to a modeled high-band excitation signal to determine a scaled high-band excitation signal;

a second synthesis filter configured to determine a second modeled high-band signal based on the scaled high-band excitation signal;

a gain estimator configured to determine gain parameters based on the second modeled high-band signal and the high-band portion of the audio signal; and a multiplexer configured to output a data stream based on the determined gain parameters.

17. The apparatus of claim 16, wherein the first synthesis filter determines a particular sub-frame of the first modeled high-band signal by applying a synthesis filter on a particular sub-frame of the modeled high-band excitation signal, wherein the synthesis filter uses filter parameters corresponding to the particular sub-frame of the modeled high-band excitation signal, and wherein a filter memory or filter states are reset to zero before applying the synthesis filter on the particular sub-frame of the modeled high-band excitation signal.

18. The apparatus of claim 17, wherein the filter parameters do not include information related to sub-frames preceding the particular sub-frame of the modeled high-band excitation signal.

19. The apparatus of claim 16, wherein the second synthesis filter determines a particular sub-frame of the second modeled high-band signal by applying a synthesis filter on a particular sub-frame of the scaled high-band excitation signal that corresponds to the particular sub-frame of the second modeled high-band signal, wherein the synthesis filter uses a filter memory or updates filter states based on the particular sub-frame of the scaled high-band excitation signal and one or more preceding sub-frames, and wherein the filter memory or the filter states are not reset to zero and are carried over from a previous frame or sub-frame before applying the synthesis filter on the particular sub-frame of the scaled high-band excitation signal.

20. The apparatus of claim 16, further comprising a low-band analysis module configured to determine a low-band bit stream, the low-band bit stream including linear prediction code data representing the low-band portion of the audio signal.

21. The apparatus of claim 16, wherein the scaling module comprises:

a first energy estimator configured to determine an energy of a particular sub-frame of the high-band portion of the audio signal;

a second energy estimator configured to determine an energy of a corresponding sub-frame of the first modeled high-band signal; and a combiner configured to determine a ratio of the energy of the particular sub-frame of the high-band portion of the audio signal to the energy of the corresponding sub-frame of the first modeled high-band signal.

22. The apparatus of claim 16, wherein the gain parameters include a gain shape and a gain frame; and further comprising:

a high-band excitation generator configured to determine the modeled high-band excitation signal by combining a transformed low-band excitation signal with a shaped noise signal;

a low-band encoder configured to determine the low-band excitation signal based on linear prediction coding of the low-band portion of the audio signal; and a high-band analysis module configured to determine high-band side information, the high-band side information including: data representing high-band line spectral pairs, data representing the gain parameters, and data representing the scaling factor.

23. The apparatus of claim 16, wherein the data stream includes a low-band bit stream and high-band side information, the low-band bit stream representing the low-band portion of the audio signal.

24. The apparatus of claim 16, further comprising:

an antenna;

a transmitter;

a receiver;

a processor;

a decoder; and an encoder comprising the first synthesis filter, the scaling module, the second synthesis filter, the gain estimator, and the multiplexer.

25. The apparatus of claim 24, wherein the antenna, the transmitter, the receiver, the processor, the decoder, and the encoder are integrated into a mobile communication device.

26. The apparatus of claim 24, wherein the antenna, the transmitter, the receiver, the processor, the decoder, and the encoder are integrated into a fixed communication unit.

27. A device comprising:

means for determining a first modeled high-band signal based on a low-band excitation signal of an audio signal, the audio signal including a high-band portion and a low-band portion;

means for determining scaling factors based on energy of sub-frames of the first modeled high-band signal and energy of corresponding sub-frames of the high-band portion of the audio signal;

means for applying the scaling factors to a modeled high-band excitation signal to determine a scaled high-band excitation signal;

means for determining a second modeled high-band signal based on the scaled high-band excitation signal;

means for determining gain parameters based on the second modeled high-band signal and the high-band portion of the audio signal; and means for outputting a data stream responsive to the means for determining gain parameters.

28. The device of claim 27, wherein the means for determining the first modeled high-band signal determines a particular sub-frame of the first modeled high-band signal by applying a synthesis filter on a particular sub-frame of the modeled high-band excitation signal, wherein the synthesis filter uses filter parameters corresponding to the particular sub-frame of the modeled high-band excitation signal, and wherein a filter memory or filter states are reset to zero before applying the synthesis filter on the particular sub-frame of the modeled high-band excitation signal such that the filter parameters do not include information related to sub-frames preceding the particular sub-frame of the modeled high-band excitation signal, and wherein the means for determining the second modeled high-band signal determines a particular sub-frame of the second modeled high-band signal by applying a second synthesis filter on a particular sub-frame of the scaled high-band excitation signal that corresponds to the particular sub-frame of the second modeled high-band signal, wherein the synthesis filter uses the filter memory or updates filter states based on the particular sub-frame of the scaled high-band excitation signal and one or more preceding sub-frames, and wherein the filter memory or the filter states are not reset to zero and are carried over from a previous frame or sub-frame before applying the synthesis filter on the particular sub-frame of the scaled high-band excitation signal.

29. The device of claim 27, wherein the means for determining the first modeled high-band signal, the means for determining the scaling factors, the means for applying the scaling factors, the means for determining the second modeled high-band signal, the means for determining the gain parameters, and the means for outputting the data stream are integrated into a mobile communication device or a fixed communication unit.

30. A non-transitory computer-readable medium storing instructions that are executable by a processor to cause the processor to perform operations comprising:

determining a first modeled high-band signal based on a low-band excitation signal of an audio signal, the audio signal including a high-band portion and a low-band portion;

determining scaling factors based on energy of sub-frames of the first modeled high-band signal and energy of corresponding sub-frames of the high-band portion of the audio signal;

applying the scaling factors to a modeled high-band excitation signal to determine a scaled high-band excitation signal;

determining a second modeled high-band signal based on the scaled high-band excitation signal;

determining gain parameters based on the second modeled high-band signal and the high-band portion of the audio signal; and outputting a data stream based on the determined gain parameters.

31. The non-transitory computer-readable medium of claim 30, wherein a particular sub-frame of the first modeled high-band signal is determined by applying a synthesis filter on a particular sub-frame of the modeled high-band excitation signal, wherein the synthesis filter uses filter parameters corresponding to the particular sub-frame of the modeled high-band excitation signal, and wherein a filter memory or filter states are reset to zero before applying the synthesis filter on the particular sub-frame of the modeled high-band excitation signal.

* * * * *